US010932065B2

(12) United States Patent
Ayache et al.

(10) Patent No.: US 10,932,065 B2
(45) Date of Patent: Feb. 23, 2021

(54) UNIVERSAL CHARGING AND DRYING STATION FOR HEARING AID

(71) Applicant: Serene Group, Inc., Norwalk, CA (US)

(72) Inventors: Jamal M. Ayache, Irvine, CA (US); Peter Lee, Huntington Beach, CA (US)

( * ) Notice: Subject to any disclaimer, the term of this patent is extended or adjusted under 35 U.S.C. 154(b) by 0 days.

(21) Appl. No.: 16/642,000

(22) PCT Filed: Dec. 29, 2018

(86) PCT No.: PCT/US2018/068067
§ 371 (c)(1),
(2) Date: Feb. 25, 2020

(87) PCT Pub. No.: WO2020/139402
PCT Pub. Date: Jul. 2, 2020

(65) Prior Publication Data

US 2020/0245079 A1 Jul. 30, 2020

(51) Int. Cl.

| | |
|---|---|
| ***H04R 25/00*** | (2006.01) |
| ***F26B 9/00*** | (2006.01) |
| ***H04R 1/12*** | (2006.01) |

(52) U.S. Cl.
CPC ..... *H04R 25/30* (2013.01); *F26B 9/003* (2013.01); *H04R 1/12* (2013.01); *H04R 25/60* (2013.01); *H04R 25/602* (2013.01); *H04R 2225/021* (2013.01); *H04R 2225/31* (2013.01); *H04R 2460/17* (2013.01)

(58) Field of Classification Search
CPC ..... H04R 1/12; H04R 25/30; H04R 25/60; H04R 25/55; H04R 25/602; H04R 2225/31; H04R 2460/17
See application file for complete search history.

(56) References Cited

U.S. PATENT DOCUMENTS

| | | | | |
|---|---|---|---|---|
| 5,640,783 | A | 6/1997 | Schumaier | |
| 6,399,920 | B1 * | 6/2002 | Guinn | F26B 9/003 219/386 |
| 7,017,276 | B2 * | 3/2006 | Greenspan | F26B 9/003 34/201 |
| 2003/0196687 | A1 | 10/2003 | Campbell et al. | |
| 2008/0128007 | A1 | 6/2008 | Stern | |

(Continued)

*Primary Examiner* — Huyen D Le
(74) *Attorney, Agent, or Firm* — Tsz Lung Yeung

(57) ABSTRACT

A universal charging and drying station includes a main unit and a hearing aid charger. The main unit includes a main casing, a lid, a hearing aid dryer, and a control circuitry. The hearing aid charging includes at least one interchangeable adapter unit, which includes a receptacle connector, a charging adapter and a connecting module. The connecting module has an adapter terminal electrically connecting to the hearing aid, and a plurality of connecting members detachably connected to the receptacle connector of the main casing. The interchangeable adapter unit may be operated between a charging mode and an interchangeable mode, wherein in the charging mode, the connecting module is electrically connected to the receptacle connector through the connecting members for charging the hearing aid, wherein in the interchangeable mode, the connecting module is detached from the receptacle connector for interchange of the interchangeable adapter unit.

23 Claims, 11 Drawing Sheets

(56) References Cited

U.S. PATENT DOCUMENTS

| | | | | |
|---|---|---|---|---|
| 2009/0074219 | A1* | 3/2009 | Klemenz | H04R 25/00 381/324 |
| 2009/0296968 | A1 | 12/2009 | Wu et al. | |
| 2010/0011613 | A1 | 1/2010 | Husung | |
| 2012/0216418 | A1 | 8/2012 | Serman et al. | |
| 2015/0162770 | A1 | 6/2015 | Choi et al. | |
| 2016/0277848 | A1 | 9/2016 | Naumann | |
| 2020/0267483 | A1* | 8/2020 | Schumaier | F26B 3/04 |

* cited by examiner

UNIVERSAL CHARGING AND DRYING STATION FOR HEARING AID

BACKGROUND OF THE PRESENT INVENTION

Field of Invention

The present invention relates to a hearing aid accessory, and more particularly to a universal charging and drying station for a hearing aid, wherein a user may selectively adopt a suitable interchangeable adapter unit to simultaneously recharge and dry his or her hearing aid.

Description of Related Arts

Hearing aids have been widely utilized throughout the world. A typical behind-the-ear hearing aid may comprise a housing which is adapted to be hung behind a user's pinna, and an earplug extended from the housing and arranged to be inserted into an external auditory canal of the user. The hearing aid may comprise a speaker/receiver and microphone module which is normally received in the housing. A rechargeable battery may be provided in the housing for powering up the entire hearing aid. An electrical terminal may be provided on the housing.

Two common hearing aid accessories are chargers and dryers. Hearing aid chargers are used to recharge the rechargeable battery while dryers may be used to remove moisture from the hearing aids. Conventionally, recharging and drying are two separate processes and a user has to use two different accessories to accomplish charging and drying. This imparts great inconvenience to users.

However, every brand of hearing aid and every model of a given brand is unique in charging contact design. Thus, a unique charger is needed for each model of hearing aid. This can substantially increase the total number of chargers an audiologist's office must carry in stock.

As a result, there is a need to develop a universal accessory for a hearing aid device which may resolve the above-mentioned problems and allow a user to charge and dry his hearing aid devices at the same time and by using one single device.

SUMMARY OF THE PRESENT INVENTION

Certain variations of the present invention provide a universal charging and drying station for a hearing aid, wherein a user may selectively adopt a suitable interchangeable adapter unit to simultaneously recharge and dry his hearing aids.

Certain variations of the present invention provide a universal charging and drying station for a hearing aid, wherein the universal charging and drying station is capable of imparting great convenience to users and facilitating substantial cost saving because a user will only need to carry one single charging unit and several interchangeable adapter units.

Certain variations of the present invention provide a universal charging and drying station for a hearing aid, wherein the universal charging and drying station will also benefits audiologists and hearing aid dispensers as they no longer need to carry multiple brands and models of hearing aid chargers and dryers in their inventory. A universal charging unit is all that is required together with several interchangeable adapter units.

Certain variations of the present invention provide a universal charging and drying station for a hearing aid, wherein the universal charging and drying station comprises a temperature control arrangement which is capable of creating two temperature zones in the universal charging and drying station.

In one aspect of the present invention, it provides a universal charging and drying station for a hearing aid having a hearing aid unit and an earbud, comprising:

a main unit, which comprises:

a main casing having a drying platform for accommodating the earbud;

a lid movably provided on the main casing for defining a utility compartment;

a hearing aid dryer supported in the main casing for drying the hearing aid on the drying platform; and a control circuitry supported in the main casing and electrically connected to the hearing aid dryer and the receptacle connector; and a hearing aid charger, which comprises:

a receptacle connector supported by the main casing and electrically connected to the control circuitry; and at least one interchangeable adapter unit, which comprises:

a charging adapter; and a connecting module supported by the charging adapter, the connecting module having at least one adapter terminal electrically connecting to the hearing aid, and at least one connecting member detachably connected to the receptacle connector, the interchangeable adapter unit being operated between a charging mode and an interchangeable mode, wherein in the charging mode, the connecting module is electrically connected to the receptacle connector through the connecting member for charging the hearing aid, wherein in the interchangeable mode, the connecting module is detached from the receptacle connector for interchange of the interchangeable adapter unit.

Another aspect of the present invention provides a universal charging and drying station for a hearing aid comprising a hearing aid unit and an earbud, the universal charging and drying station comprising:

a main casing having a drying platform for accommodating the earbud of the hearing aid;

a lid movably provided on the main casing for defining a utility compartment as a space formed between the lid and the main casing;

a hearing aid charger comprising a charging adapter having an adapter terminal provided on the main casing for electrically connecting to the hearing aid;

a hearing aid dryer supported in the main casing;

a control circuitry supported in the main casing and electrically connected to the hearing aid dryer and the charging adapter; and a temperature control arrangement, which comprises:

a partitioning member provided on the main casing to divide the utility compartment into a drying chamber for accommodating at least the earbud of the hearing aid, and a charging chamber for accommodating the hearing aid unit of the hearing aid; and at least one air inlet formed on the main casing for allowing air which has lower temperature than that of the charging chamber to be drawn therein for creating two different temperature zones for the drying chamber and the charging chamber respectively.

This summary presented above is provided merely to introduce certain concepts and not to identify any key or essential features of the claimed subject matter.

DETAILED DESCRIPTION OF THE PREFERRED EMBODIMENT

Figure 1:
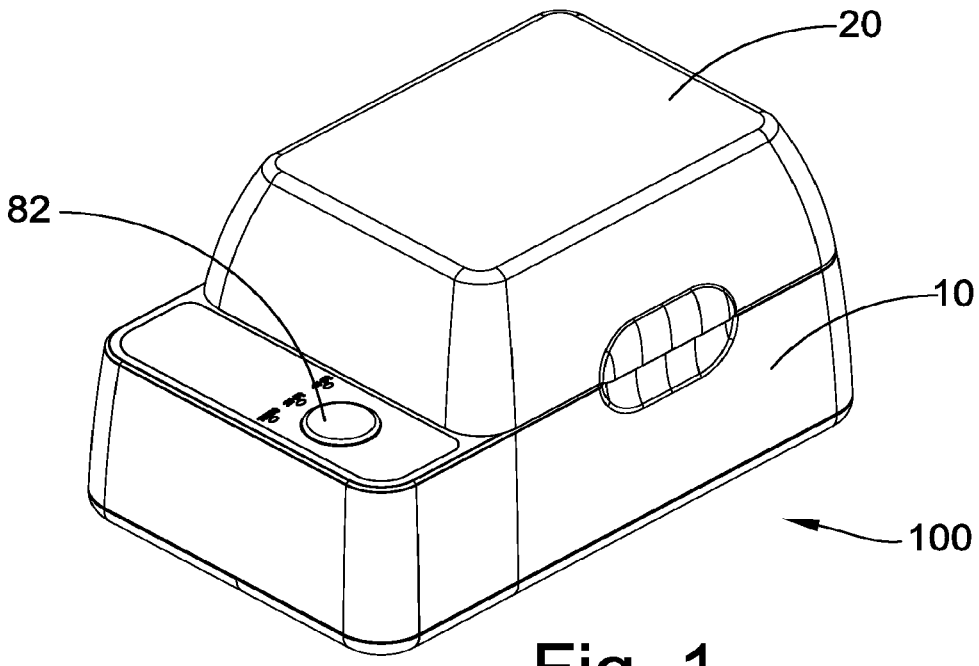
FIG. 1 is a perspective view of a universal charging and drying station according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 8 of the drawings, a universal charging and drying station according a preferred embodiment of the present invention is illustrated. The universal charging and drying station may be primarily for use with at least one conventional hearing aid 200 having a hearing aid unit 201 and an earbud 202 extended from the hearing aid unit 201. At least one charging terminal 203 may be formed on the hearing aid unit 201 for charging of the hearing aid 200. A rechargeable battery (not shown) may be provided in the hearing aid unit 201 for providing power to the entire hearing aid 200. Broadly, the universal charging and drying station may comprise a main unit 100 and a hearing aid charger 500 comprising a receptacle connector 11 and at least one interchangeable adapter unit 50. The main unit 100 may comprise a main casing 10 having a drying platform 160 for accommodating the earbud 202, a lid 20, a hearing aid dryer 30, and a control circuitry 40.

The lid 20 may be movably provided on the main casing 10 for defining a utility compartment 21. The hearing aid dryer 30 may be supported in the main casing 10 for drying the hearing aid 200 in the utility compartment 21.

The control circuitry 40 may be supported in the main casing 10 and electrically connected to the hearing aid dryer 30 and the receptacle connector 11.

The interchangeable adapter unit 50 may comprise a charging adapter 51 and a connecting module 52.

The connecting module 52 may be supported by the charging adapter 51. The connecting module 52 may have at least one adapter terminal 521 electrically connecting to the hearing aid 200, and at least one connecting member 522 electrically connected to the receptacle connector 11. The interchangeable adapter unit 50 may be operated between a charging mode and an interchangeable mode, wherein in the charging mode, the connecting module 52 may be electrically connected to the receptacle connector 11 through the connecting member 522 for charging the hearing aid 200, wherein in the interchangeable mode, the connecting module 52 may be electrically disconnected from the receptacle connector 11 for interchange of the interchangeable adapter unit 50.

According to the preferred embodiment of the present invention, the main casing 10 may have a substantially rectangular cross-sectional shape and may have a utility platform 12, at least one surrounding sidewall 13, a bottom wall 14, and a receiving cavity 15 formed at a space surrounded by the utility platform 12, the surrounding sidewall 13, and a bottom wall 14. The utility platform 12 may be formed on a top side of the main casing 10. It is worth mentioning that the main casing 10 may have other cross-sectional shapes and the utility platform 12 may formed on any one side of the main casing 10. The exact configuration of the main casing 10 may depend on manufacturing and marketing circumstances of the present invention. The utility platform 12 may provide a platform for accommodating or supporting the hearing aid 200 and the interchangeable adapter unit 50.

In this preferred embodiment, the universal charging and drying station may be designed and used for simultaneously charging and drying two hearing aids 200. The description below will assume that the universal charging and drying station will be used for two hearing aids 200. However, note that the present invention may also be used for at least one hearing aid 200, and the number of hearing aids 200 that could be charged or dried may depend on manufacturing and marketing circumstances of the present invention, and is not meant to be limiting.

The lid 20 may have a hollow structure to form a lid cavity so that when the lid 20 is moved to cover on the main casing 10, the lid cavity may form the utility compartment 21 as described earlier. The utility compartment 21 may thus be defined as the space surrounded by the lid 20 and the utility platform 12 when the lid 20 is closed with respect to the main casing 10.

Figure 2:
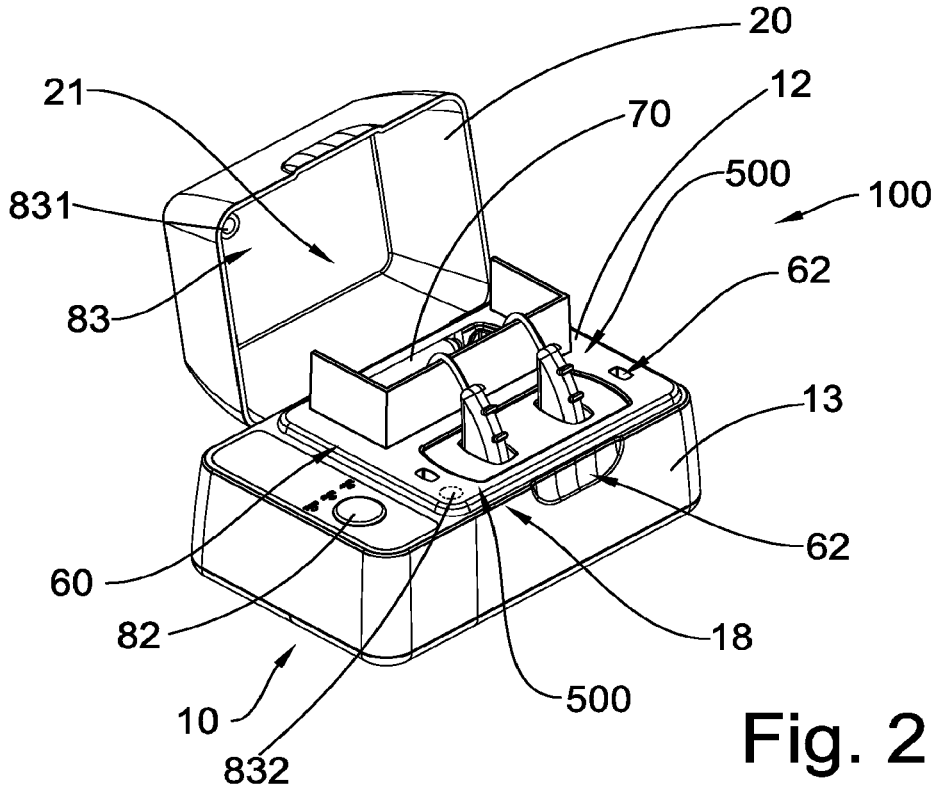
FIG. 2 is another perspective view of the universal charging and drying station according to the preferred embodiment of the present invention, illustrating that the lid is opened.

The lid 20 may be designed to have a wide variety of shapes and contours. In this preferred embodiment, the lid 20 may be shaped and designed to have a cubic structure or having a rectangular cross-sectional shape, as shown in FIG. 1 and FIG. 2 of the drawings.

The hearing aid dryer 30 may be received in the receiving cavity 15 of the main casing 10 for primarily drying the earbuds 202 of the hearing aids 200. The hearing aid dryer 30 may comprise at least one of an air dryer 31 and a heater dryer 32. In the preferred embodiment of the present invention, the hearing aid dryer 30 may comprise both of the air dryer 31 and the heater dryer 32. The air dryer 31 may comprise at least one fan 311 provided in the receiving cavity 15 of the main casing 10, whereas the heater dryer 32 may comprise at least one heater resistor 321 electrically connected to the control circuitry 40 for generating a predetermined amount of heat to dry the earbuds 202 of the hearing aids 200. The heater dryer 32 may further comprise a thermistor 322 electrically connected to the control circuitry 40 and the heater resistor 321 such that a temperature of the heater resistor can be monitored accurately by the thermistor 322. A resistance of the thermistor changes with temperature and this resistance information is transmitted to the control circuitry 40 so that the control circuitry 40 may vary the amount of power delivering to the heater resistor 321. The goal of this feedback action is for the control circuitry 40 to maintain the desired thermistor resistance by automatically varying the power to the heater resistor 321. Therefore, a desired temperature is maintained by the heater resistor 321 which may directly maintain a constant temperature on drying cavity 16 and may sits immediately above the heater resistor 321.

In order to facilitate effective drying of the earbuds 202 of the hearing aids 200, the main casing 10 may have a drying cavity 16 indently formed on the utility platform 12 wherein the drying platform 160 may be provided in the drying cavity 16 for allowing the earbud 202 to be disposed therein and rest on the drying platform 160. Thus, the drying platform 160 may form as a bottom wall of the drying cavity 16. The drying cavity 16 may also be surrounded by at least one surrounding sidewall 161. The main casing 10 may further has a plurality of ventilating meshes 17 formed on at least one of the surrounding sidewall 161 of the drying cavity 16 and the drying platform 160, wherein the hearing aid dryer 30 is arranged to dry primarily the earbuds 202 of the hearing aids 200 through the ventilating meshes 17 when the earbuds 202 are disposed on the drying platform 160.

It is worth mentioning that the drying cavity 16 may be integrally formed on the main casing 10. Alternatively, the drying cavity 16 may be formed on a supporting tray which may be provided on the main casing 10. The supporting tray may have the ventilating meshes 17 formed thereon. Yet another alternative is that the ventilating meshes 17 may be formed on the drying platform 160 while the main casing 10 may not have any indented drying cavity 16. In this scenario, the earbuds 202 may be disposed on the drying platform 160 provided on the utility platform 12.

The control circuitry 40 may comprise a Printed Circuit Board (PCB 41) and a control circuit 42 implemented on the PCB 41 for controlling the hearing aid dryer 30 and the hearing aid charger 500. The PCB 41 may be supported in the receiving cavity 15 of the main casing 10. The control circuit 42 may be made up by a plurality of electronic components connected in a predetermined configuration.

The receptacle connector 11 may be electrically connected to the control circuitry 40 and may comprise a plurality of connector terminals 111 detachably connected to the charging adapter 51. In this preferred embodiment, connector terminals 111 may be provided on the PCB 41. The receptacle connector 11 may further comprise a connector base 112 provided on the PCB 41 wherein the connector terminals 111 may be provided on the connector base 112. The connector base 112 may support and protect the connector terminals 111.

The universal charging and docking station of the present invention may comprise a plurality of interchangeable adapter units 50 wherein each of the interchangeable adapter units 50 may be specifically adapted for charging a predetermined type or predetermined brand of hearing aid 200. As mentioned earlier, each of the interchangeable adapter units 50 may be freely attached to and detached from the receptacle connector 11 so that a user may use the most appropriate interchangeable adapter units 50 which suits his or her brand or type of hearing aid 200.

Each of the interchangeable adapter units 50 may comprise the charging adapter 51 and the connecting module 52 supported by the charging adapter 51. The charging adapter 51 may have at least one supporting seat 511 for securely supporting at least one hearing aid unit 201 of the hearing aid 200. As mentioned earlier, each of the interchangeable adapter units 50 may be designed for charging two hearing aids 200 so that the charging adapter 51 may have two supporting seats 511 spacedly formed thereon, and each of the interchangeable adapter units 50 may comprise a plurality of adapter terminals 521. Each of the supporting seats 511 may have a predetermined contour for fitting the corresponding portion of the hearing aid units 201 of the hearing aids 200. The adapter terminals 521 may be provided on the supporting seats 511 for electrically connecting to the charging terminals 203 of the hearing aid units 201. The receptacle connector 11 may comprise a plurality of connector terminals 111. Depending on the shape and size of the supporting seats 511 and the position of the charging terminals 203, the hearing aid units 200 may be supported in an upright orientation or lie down on the charging adapter 51. Each of the supporting seats 511 may be a specifically shaped indention formed on the charging adapter 5, such as the hearing aid units 201 shown in FIG. 2 of the drawings.

Figure 5:
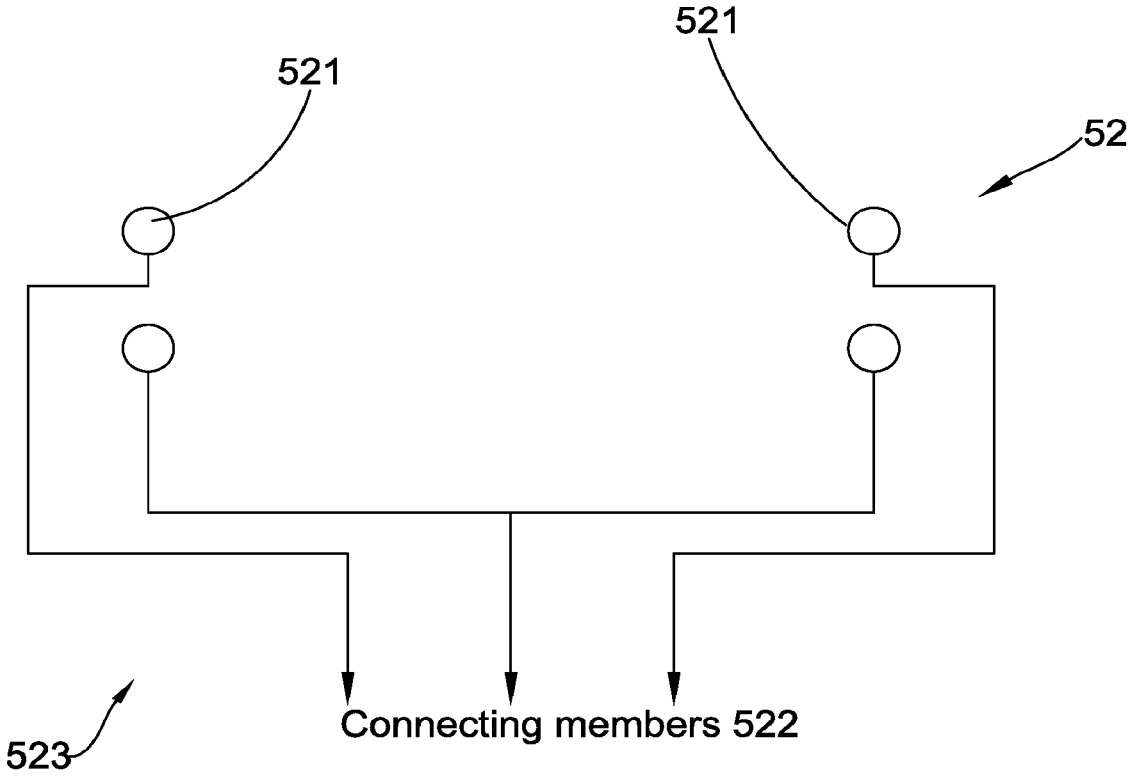
FIG. 5 is a schematic diagram of a connecting circuit of an interchangeable adapter unit according to the preferred embodiment of the present invention.

Referring to FIG. 5 of the drawings, the connecting module 52 may comprise a connecting circuit 523 supported by the corresponding charging adapter 51 wherein the adapter terminals 521 may be form ed as electrical contacts or terminals of the connecting circuit 523. Moreover, the connecting module 52 may further comprise a plurality of connecting members 522 each of which may be embodied as a connecting pin for electrically connecting to the connector terminals 111 of the receptacle connector 11. Preferably, the connecting members 522 may downwardly extend from the charging adapter 51. The connecting members 522 may form another set of electrical contacts of the connecting circuit 523. Thus, the connecting circuit 523 may electrically connect the connector terminals 111 of the receptacle connector 11 to the charging terminals 203 of the hearing aids 200. The electrical connection between the receptacle connector 11 and the connecting module 52 may be accomplished through direct mechanical contacts between the connector terminals 111 and the connecting members 522.

The main casing 10 may further has a through receptacle slot 110 formed on the utility platform 12 at a position corresponding to that of the receptacle connector 11. In other words, the receptacle connector 11 may expose to the utility compartment 21 through the receptacle slot 110. The receptacle slot 110 may be shaped and size to correspond to the charging adapter 51 so that the charging adapter 51 may fit into the receptacle slot 110 so as to allow the connecting members 522 to electrically connect to the connector terminals 111 of the receptacle connector 11.

The universal charging and drying station may further comprise a temperature control arrangement 60 for optimizing a temperature in the various parts of the utility compartment 21. The reason for having the temperature control arrangement 60 is to control the temperature of the different portions of the utility compartment 21 so that the drying and charging operations of the universal charging and drying station can be carried out in the most favorable temperature. Thus, a multi-zone temperature profile for drying is established inside the main unit 100 so as to offer one temperature zone for drying moisture off the earbuds 202, while simultaneously offering a different temperature zone for drying the hearing aid units 201 where the battery is being charged.

Figure 7:
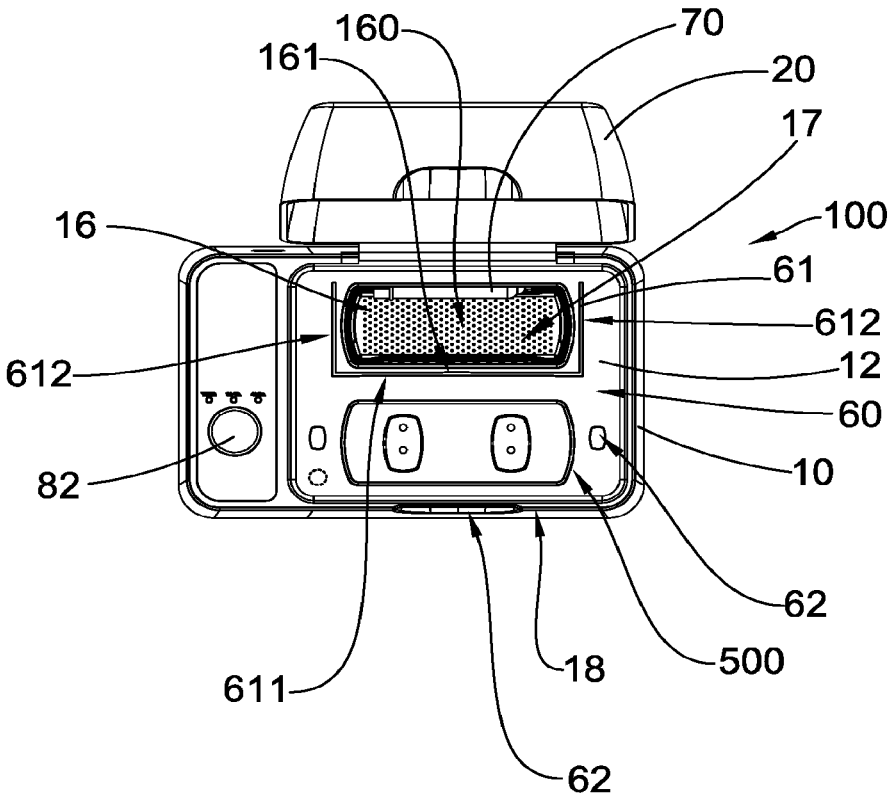
FIG. 7 is a top view of the universal charging and drying station according to the preferred embodiment of the present invention.
Figure 8:
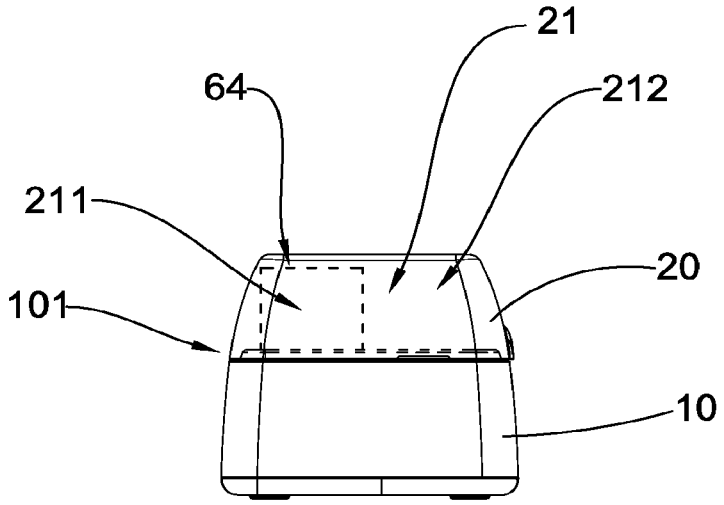
FIG. 8 is a side view of the universal charging and drying station according to the preferred embodiment of the present invention.

Specifically, the temperature control arrangement 60 may comprise a partitioning member 61 and at least one air inlet 62 as illustrated in FIG. 7 and FIG. 8 of the drawings. As shown in FIG. 7 to FIG. 8 of the drawings, the partitioning member 61 may be provided on the main casing 10 to divide the utility compartment 21 into a drying chamber 211 for accommodating at least one earbud 202 of the hearing aid 200, and a charging chamber 212 for accommodating at least the hearing aid unit 201 of the hearing aid 200. As mentioned above, the present invention may be primarily designed for charging and drying two hearing aids 200. As such, the drying chamber 211 and the charging chamber 212 may be shaped and sized to accommodate at least two earbuds 202 and two main units 201 respectively.

In this preferred embodiment, the temperature control arrangement 60 may have three air inlets 62. The air inlets 62 may be formed on the main casing 10 for allowing air which has lower temperature than that of the charging chamber 212 to be drawn therein. With the operation of the fan 311, air may be drawn into the charging chamber 212. Simultaneously, different amount of air may also be drawn into the drying chamber 211 via ventilating mesh 17 of the drying cavity 16. Alternatively, air may also be sucked out from the charging chamber 212 or drying chamber 211. For example, the fan 311 may be controlled by the control circuitry 40 such that the fan may rotate in one direction (e.g. clockwise direction) which may draw air from the receiving cavity 15 into the charging chamber 212. At the same time, a different amount of air may be draw into the drying chamber 211 via ventilating mesh 17 of the drying cavity 16. Conversely, the fan 311 may be controlled by the control circuitry 40 such that the fan may rotate in an opposite direction (e.g. counter-clockwise direction) which may then suck air out from the charging chamber 212 while a different amount of air may be sucked from the drying chamber 211.

Figure 6:
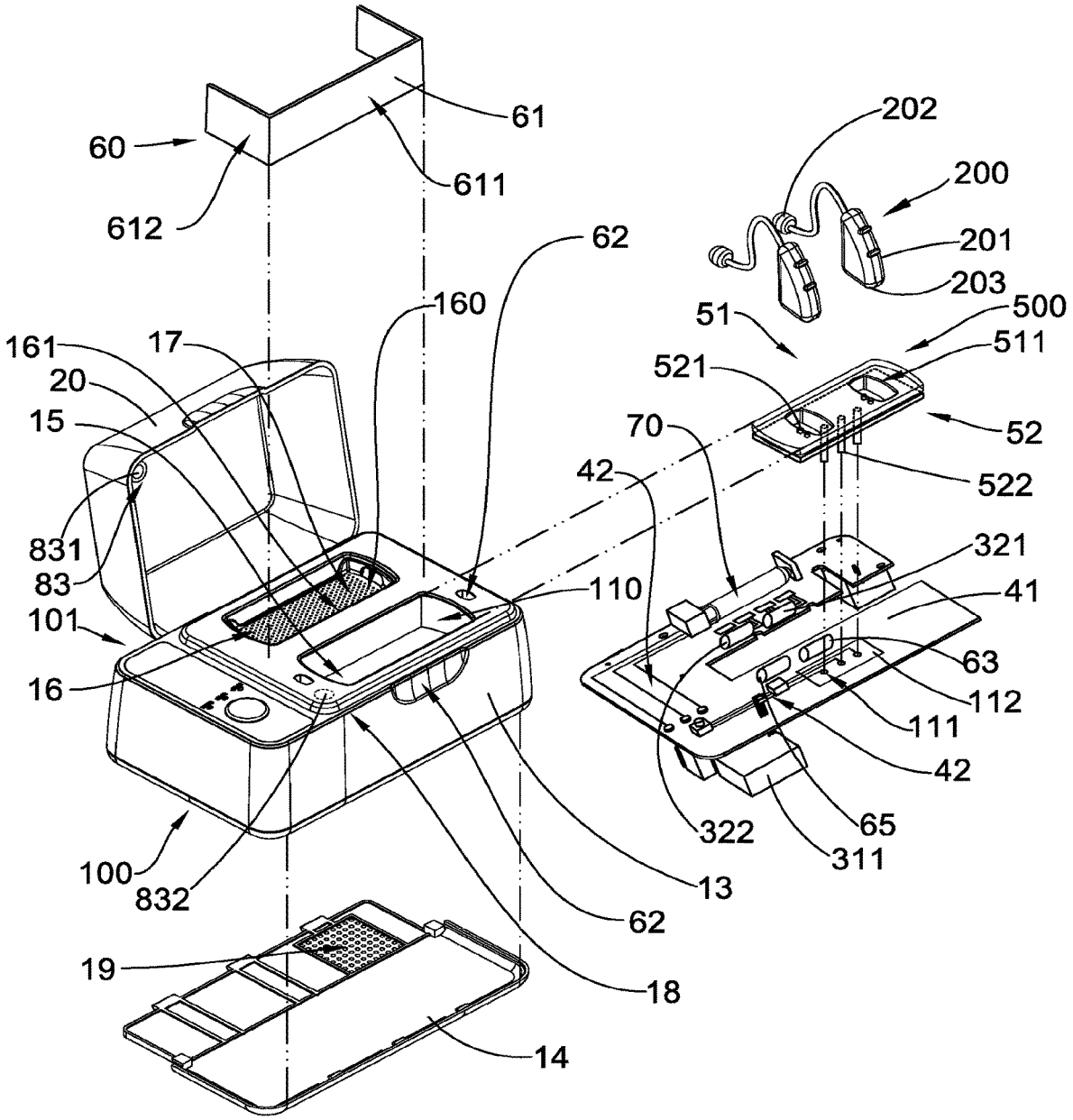
FIG. 6 is an exploded perspective view of the universal charging and drying station according to the preferred embodiment of the present invention.

According to the preferred embodiment of the present invention, the partitioning member 61 may have a U-shaped cross section as viewed from the top and may be mounted on the utility platform 12 to enclose or surround the drying cavity 16. As shown in FIG. 6 to FIG. 8 of the drawings, the partitioning member 61 may have a front portion 611 and two side portions 612 rearwardly extended from two ends of the front portion 611. The space surrounded by the partitioning member 61 and the lid 20 in the utility compartment 21 may be defined as the drying chamber 211 for the purpose of forming a first temperature zone for the universal charging and drying station. On the other hand, the space outside the drying chamber 211 in the utility compartment 21 may be defined as the charging chamber 212 for the purpose of forming a second temperature zone for the universal charging and drying station. The front portion 611 may be positioned between a side edge 161 of the drying cavity 16 and the interchangeable adapter unit 50.

The air inlet 62 may be a through inlet and formed on the utility platform 12 in the charging chamber 212 of the utility compartment 21. The temperature control arrangement 60 may have three air inlets 62 altogether. As shown in FIG. 6 of the drawings, two of the air inlets 62 may be formed on two sides of the receptacle slot 110, while the remaining air inlet 62 may be formed on a front edge portion 18 of the main casing 10.

Each of the air inlets 62 and ventilating mesh 17 of the drying cavity 16 may communicate the receiving cavity 15 of the main casing 10 with the charging chamber 212 of the utility compartment 21. Ambient air may be drawn from external environment to the receiving cavity 15 through a plurality of through openings 19 formed on the main casing 10. The through openings 19 may communicate the receiving cavity 15 with ambient environment. Preferably, the through openings 19 may be formed on the bottom wall 14 of the main casing 10. Of course, the through openings 19 may also be formed on the sidewall 13 of the main casing 10.

The temperature control arrangement 60 may further comprise a temperature control heater 63 supported by the main casing 10 and electrically connected to the control circuitry 40 for raising a temperature of the charging chamber 212 of the utility compartment 21. The temperature control heater 63 may be also be embodied as at least one heater resistor 321 for generating a controlled amount of heat. It is worth mentioning that the heater dryer 32 and the temperature control heater 63 may be positioned in the receiving cavity 15 such that they may be arranged to primarily increase the temperature of the drying chamber 211 and the charging chamber 212 respectively. Thus, by controlling each or both of the heater dryer 32 and the temperature control heater 63, a user may be able to precisely and accurately control the temperature of each of the drying chamber 211 and the charging chamber 212. The heater resistors 321 may be mounted on the PCB 41 at positions corresponding to the drying chamber 211 and the charger chamber 212 respectively. The temperature control arrangement 60 may further comprise a temperature control thermistor 65 electrically connected to the control circuitry 40 and the temperature control heater 63 such that a temperature of the temperature control heater 63 can be monitored accurately by the temperature control thermistor 65. A resistance of the thermistor changes with temperature and this resistance information is transmitted to the control circuitry 40 so that the control circuitry 40 may vary the amount of power delivering to the temperature control heater 63. The goal of this feedback action is for the control circuitry 40 to automatically vary the power delivered to the temperature control heater 63. Therefore, a desired temperature is maintained by the temperature control heater 63 which may directly maintain a constant temperature on charging chamber 212.

Typically, battery manufacturers recommend a maximum charging temperature of 30° C. for silver zinc battery (AgZn). The preferred embodiment of the present invention provides the air inlets 62 so cooler ambient air can be brought into the charging chamber 212 so as to lower the temperature around the hearing aid unit 201 while the drying chamber 211 may operate at a higher temperature for drying the earbuds 202.

In this preferred embodiment of the present invention, a height of the front portion 611 and the side portions 612 may be identical so that each of the front portion 611 and the side portions 612 may have a substantially rectangular cross-sectional shape, and the height of the partitioning member 61 may be uniform.

Moreover, the height of the partitioning member 61 may be slightly less than that of the utility compartment 21 so as to create a small gap 64 between a top edge 614 of the partitioning member 61 and an inner surface of the lid 20 so that the earbuds 202 of the hearing aids 200 may fittedly pass through the small gap 64 to rest on the drying chamber 211. This configuration may help creating the temperature gradient between the drying chamber 211 and the charging chamber 212 by avoiding air in the drying chamber 211 and the charging chamber 212 from substantially mixing together as the air in the two chambers 211, 212 may have different temperatures.

Figure 9:
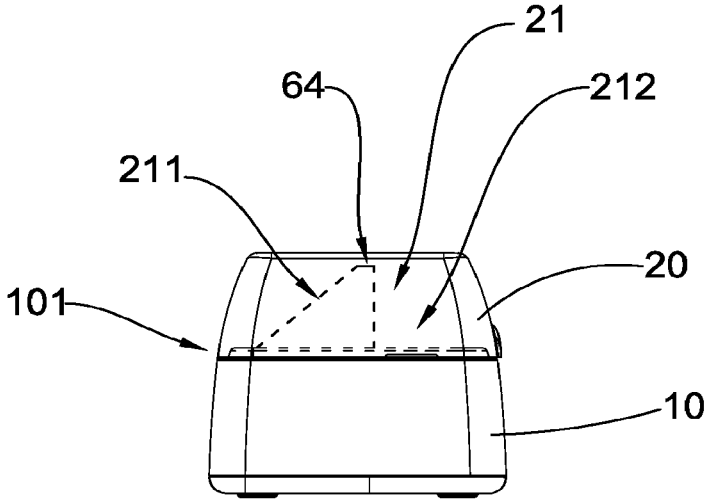
FIG. 9 illustrates an alternative height of a partitioning member of the universal charging and drying station according to the preferred embodiment of the present invention.

Alternatively, a height of the front portion 611 above the utility platform 12 may be uniform along a longitudinal length of the front portion 611 of the partitioning member 61 while a height of each of the side portions 612 may gradually decrease from the corresponding side edge of the front portion 611 toward a rear side edge 101 of the main casing 10. Thus, each of the side portions 612 may have a triangular cross-sectional shape when viewed from the side, as shown in FIG. 9 of the drawings.

Figure 3:
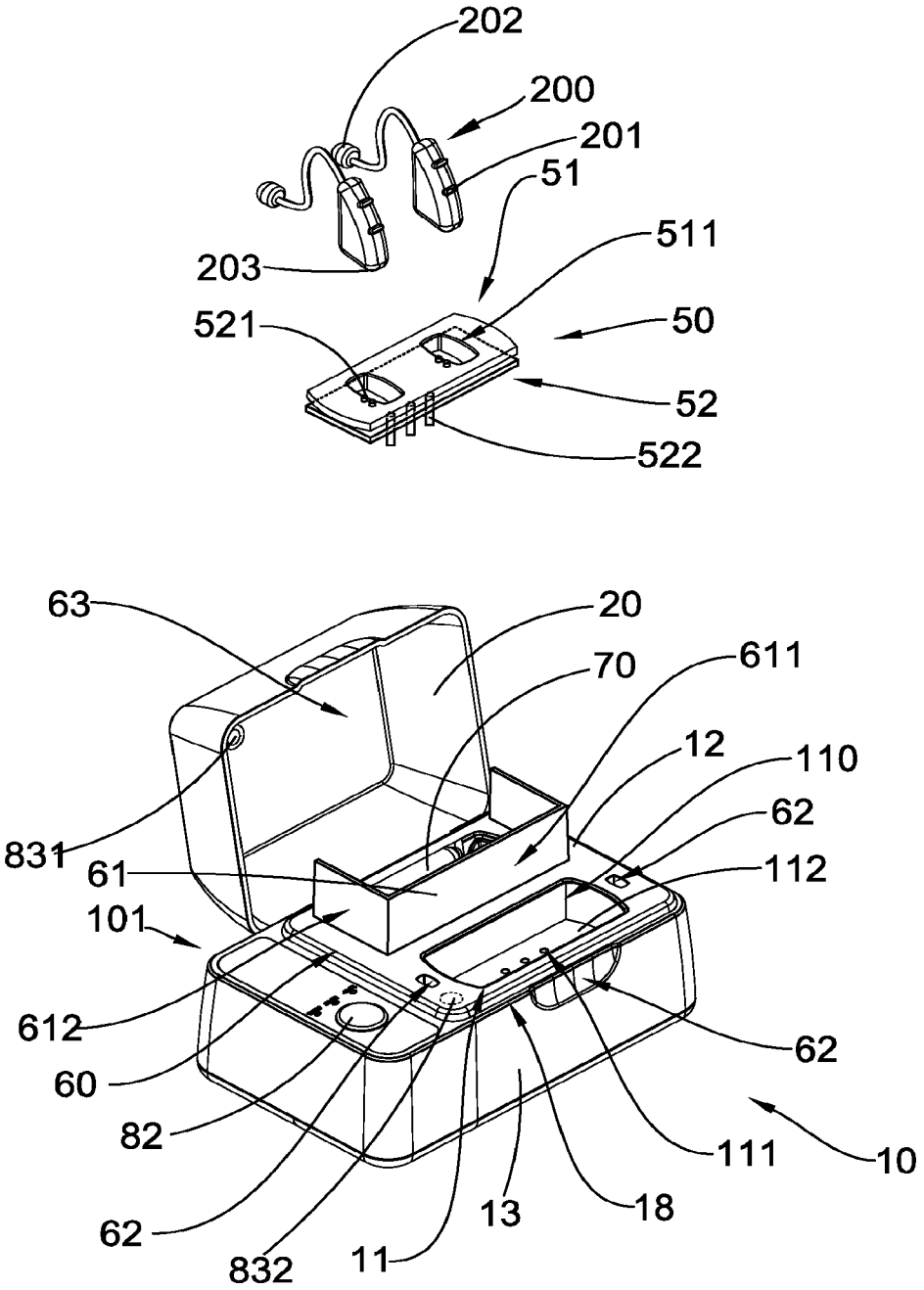
FIG. 3 is another perspective view of the universal charging and drying station according to the preferred embodiment of the present invention, illustrating the interchangeable module is removed.
Figure 4:
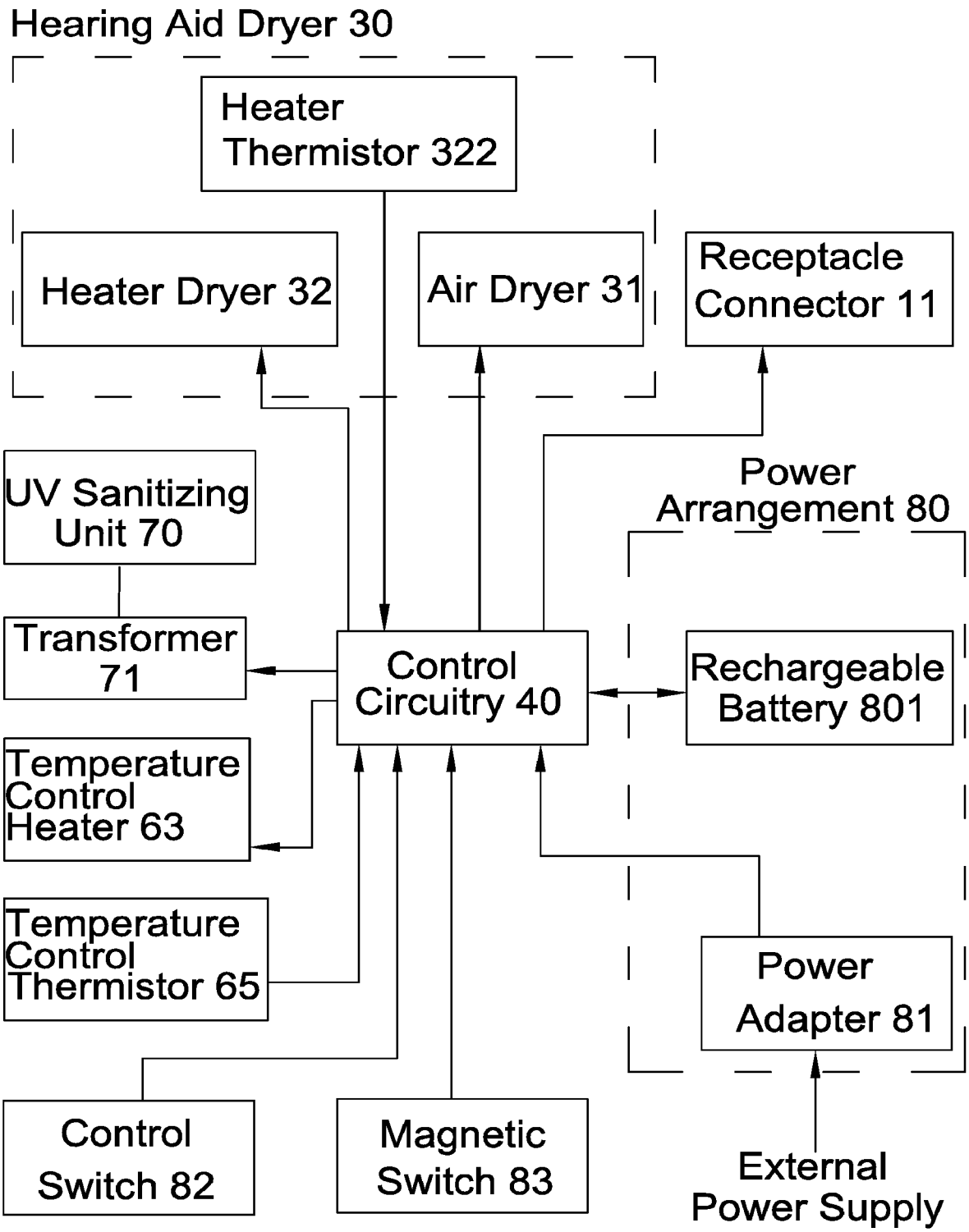
FIG. 4 is a block diagram of the universal charging and drying station according to the preferred embodiment of the present invention, illustrating the internal components of the universal charging and drying station.

As shown in FIG. 2 to FIG. 4 of the drawings, the universal charging and drying station may further comprise an Ultra-violet (UV) sanitizing unit 70 supported by the main casing 10 and electrically connected to the control circuitry 40. The UV sanitizing unit 70 may be arranged to generate UV radiation and communicate with the earbuds 202 of the hearing aids 200 when they are disposed in the drying cavity 16. The UV radiation generated by the UV sanitizing unit 70 may be arranged to reach the earbuds. A transformer 71 may be received in the main casing 10 and electrically connected to the UV sanitizing unit 70 for providing power thereto. In this preferred embodiment, the UV sanitizing unit 70 may be supported on the drying platform 160 so that UV radiation may reach the earbuds 202 when they are being dried by the hearing aid dryer 30.

The universal charging and drying station may further comprise a power arrangement 80 supported by the main casing 10 for acquiring power and supplying it to the control circuitry 40, which may then drive the various components of the universal charging and drying station to operate. The power arrangement 80 may acquire electrical power from an external power source, such as an external AC power source.

Thus, the power arrangement 80 may comprise a power supply adapter 81 electrically connected to the control circuitry 40. The power supply adapter 81 may also be electrically connected to an external power source such as an AC external power source for converting AC power to DC power and supplying it to the control circuitry 40. Note that the power supply adapter 81 may be supported in the main casing 10. Alternatively, the power supply adapter 81 may also be provided as a separate unit which may be electrically connected to the main casing through a power cord.

The power arrangement 80 may further comprise a rechargeable battery 801 accommodated in the receiving cavity 15 and electrically connected to the control circuitry 40. The rechargeable battery 801 may provide an additional portable power source for the universal charging and drying station when an external power source is not immediately available. The rechargeable battery 801 may be an optional component. The presence or absence of the rechargeable battery 801 may depend on actual manufacturing and marketing circumstances of the present invention.

The universal charging and drying station may further comprise a control switch 82 provided on the main casing 10 for allowing a user to control an operation of the present invention. In addition, the universal charging and drying station may further comprise a magnetic switch 83 provided on the main casing 10. Specifically, the magnetic switch 83 may comprise a first magnetic member 831 provided on the lid 20 and a second magnetic member 832 provided in the receiving cavity 15 and electrically connected to the control circuitry 40, in such a manner that when the lid 20 is moved to close the universal charging and drying station, the first magnetic member 831 and the second magnetic member 832 may be magnetically attracted with each other to activate operation of the drying and/or the charging function.

The operation of the present invention is as follows: a user of the present invention may have a single main unit 100 and a plurality of interchangeable adapter units 50. Each of the interchangeable adapter units 50 may be specifically designed for charging a predetermined type or brand of hearing aid 200. In this preferred embodiment, a maximum of two hearing aids 200 may be simultaneously charged and dried by the present invention. After using the hearing aids 200, a user may dispose the hearing aid units 201 on the supporting seats 511 and electrically connect the charging terminals 203 to the adapter terminals 521 respectively. The hearing aid units 201 may then be securely supported and disposed in the charging chamber 212. At the same time, the earbuds 202 may extend from the hearing aid units 201 respectively to rest in the drying cavity 16. After the hearing aids 200 are properly positioned on the utility platform 12, a user may pivotally move the lid 20 toward the utility platform 12 and close and substantially seal the drying chamber 211 and the charging chamber 212. Upon closing, the first magnetic element 831 provided in the lid 20 magnetically attracts to the second magnetic element 832 and activate the control circuit 40 for operation. The user may then switch on the control switch 82 and start the charging and drying operations. This is the charging mode of the present invention referred above. The temperature of each of the drying chamber 211 and the charging chamber 212 may be individually controlled so as to achieve the most favorable temperature for each chamber.

When the user wants to use the present invention to charge another brand of hearing aid 200, he or she may detach the charging adapter 51 and the connecting module 52 from the receptacle connector 11. This is the interchangeable mode of the present invention referred above. In this manner, the electrical connection between the receptacle connector 11 and the connecting module 52 may be disconnected through mechanical detachment of the connecting members 522 from the connector terminals 111. The user may then select a suitable interchangeable adapter unit 50 and electrically connect the interchangeable adapter unit 50 to the receptacle connector 11 and operate the universal charging and drying station in the charging mode again.

From the forgoing descriptions, it can be shown that the universal charging and drying station of the present invention comprises a single main unit 100 and a plurality of removable or interchangeable adapter units 50. A dedicated charging adapter 51 and a connecting module 52 may be provided for each corresponding model or brand of hearing aid 200. Such dedicated charging adapter 51 and the connecting module 52 can be removably attached to the main unit 100. Thus, since cost of the main unit 100 is expected to be more than 95% of the total cost, and the cost of each interchangeable adapter unit 50 may be only less than 5% of the total cost, thus, audiologists and hearing aid dispensers may save substantial inventory cost by stocking a small number of main units 100 and as many interchangeable adapter units 50 as needed.

Figure 10:
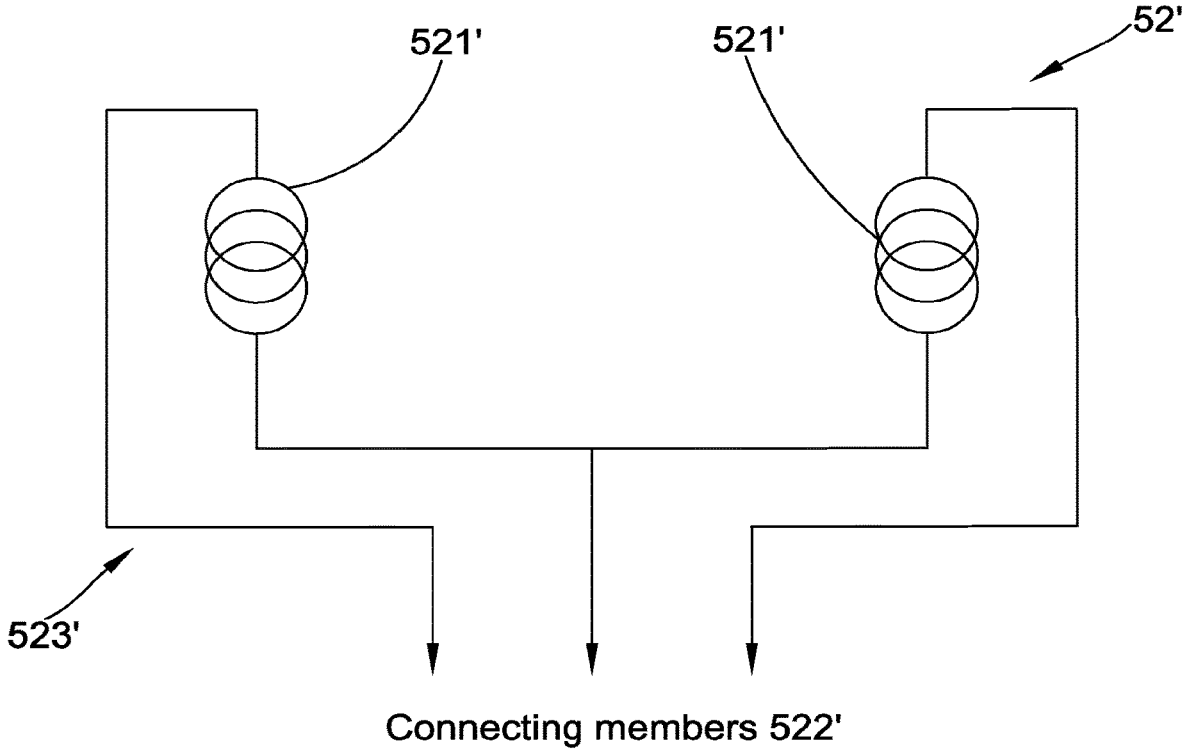
FIG. 10 is first alternative mode of the universal charging and drying station according to the preferred embodiment of the present invention, illustrating that the interchangeable adapter unit may charge a hearing aid in a wireless manner.

Referring to FIG. 10 of the drawings, a first alternative mode of the universal charging and drying station according to the preferred embodiment of the present invention is illustrated. The first alternative mode is identical to the preferred embodiment except the interchangeable adapter unit 50'.

According to the first alternative mode of the present invention, each of the interchangeable adapter units 50 may comprise the charging adapter 51 and the connecting module 52' supported by the charging adapter 51. The charging adapter 51 is identical to that described above. However, the connecting module 52' may comprise a connecting circuit 523' supported by the corresponding charging adapter 51. The connecting circuit 523' may comprise a plurality of wireless inductive charging coils 521' and a plurality of connecting members 522' each of which is embodied as a connecting pin for electrically connecting to the connector terminals 111 of the receptacle connector 11. Preferably, the connecting members 522' may downwardly extend from the charging adapter 51, as in the preferred embodiment described above.

The wireless inductive charging coils 521' may be arranged to be placed in the vicinity of the charging terminals 203 of the hearing aid units 200 while the connecting members 522' may form another set of electrical contacts of the connecting circuit 523'. The connecting circuit 523' may electrically connect the connector terminals 111 of the receptacle connector 11 to the charging terminals 203 of the hearing aids 200. The difference between the first alternative mode and the preferred embodiment as described above is that in the first alternative mode, the interchangeable adapter unit 50 supports wireless charging for the hearing aids 200. Before each charging and drying operation, the control circuitry 40 samples the resistance between different connector terminals 111 of receptacle connector 11 to detect the presence of the charging coils 521' and then applying appropriate wireless charging voltages to each charging coil 521'. A resistance of each of the inductive charging coils 521' may be less than 50 Ohms to achieve better performance.

Figure 11:
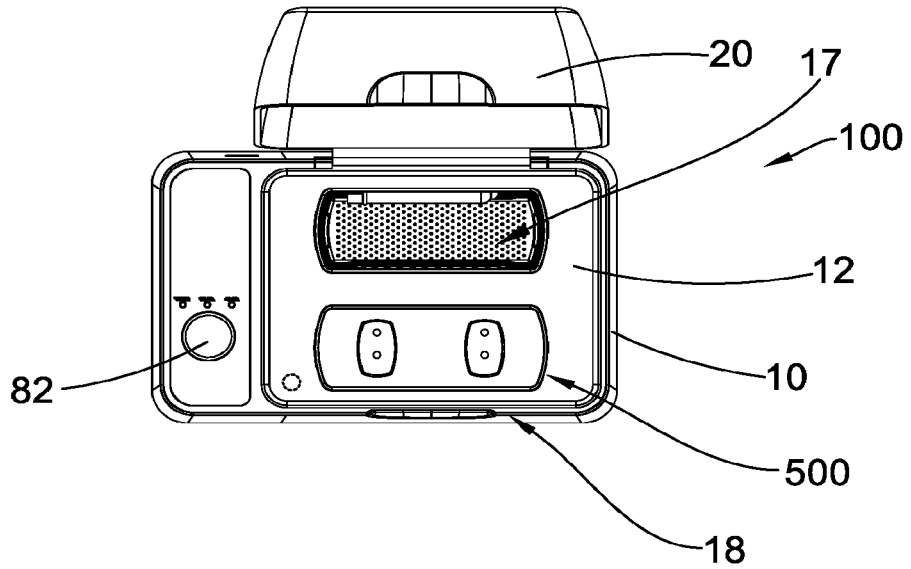
FIG. 11 a second alternative mode of the universal charging and drying station according to the preferred embodiment of the present invention.

Referring to FIG. 11 of the drawings, a second alternative mode of the present invention is illustrated. The second alternative mode is similar to the preferred embodiment, except the universal charging and drying station of the present invention may be configured such that the components mentioned in the preferred embodiment may be selectively provided on the main unit 100. For example, as a second alternative mode, the universal charging and drying station may comprise a main unit 100 and a plurality of interchangeable adapter units 50, wherein the main unit 100 is not equipped with the temperature control arrangement 60 described above.

Thus, the final product of the universal charging and drying station may be identical to the one described in the preferred embodiment above, except the absence of the temperature control arrangement 60. Nevertheless, the universal charging and drying station may also be equipped with the connecting circuits 523' described in the first alternative mode above.

Figure 12:
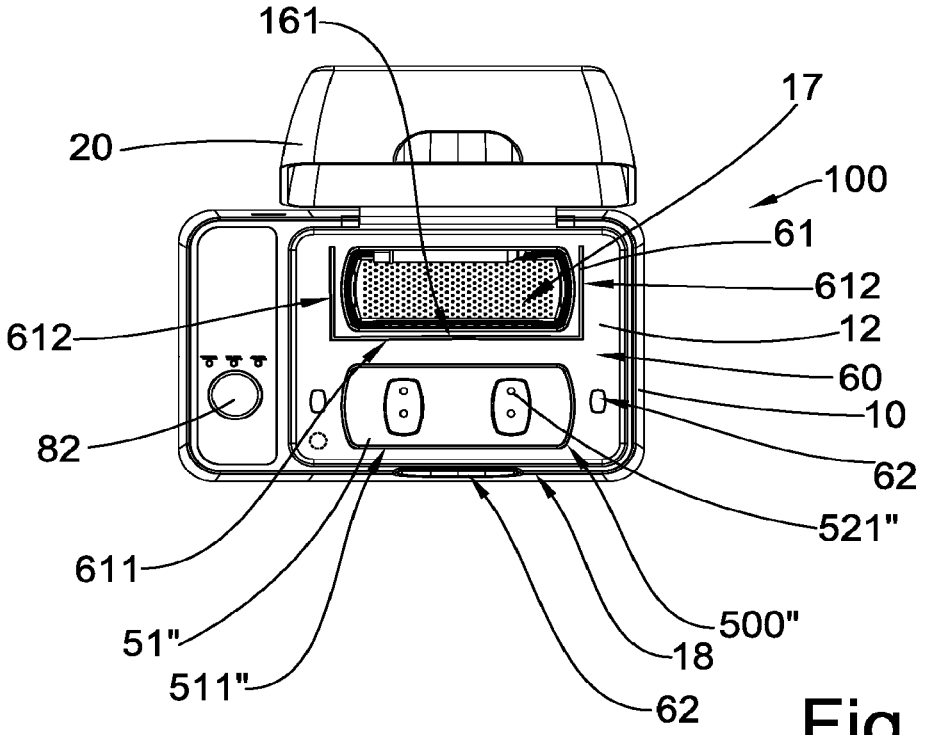
FIG. 12 is a third alternative mode of the universal charging and drying station according to the preferred embodiment of the present invention.
Figure 13:
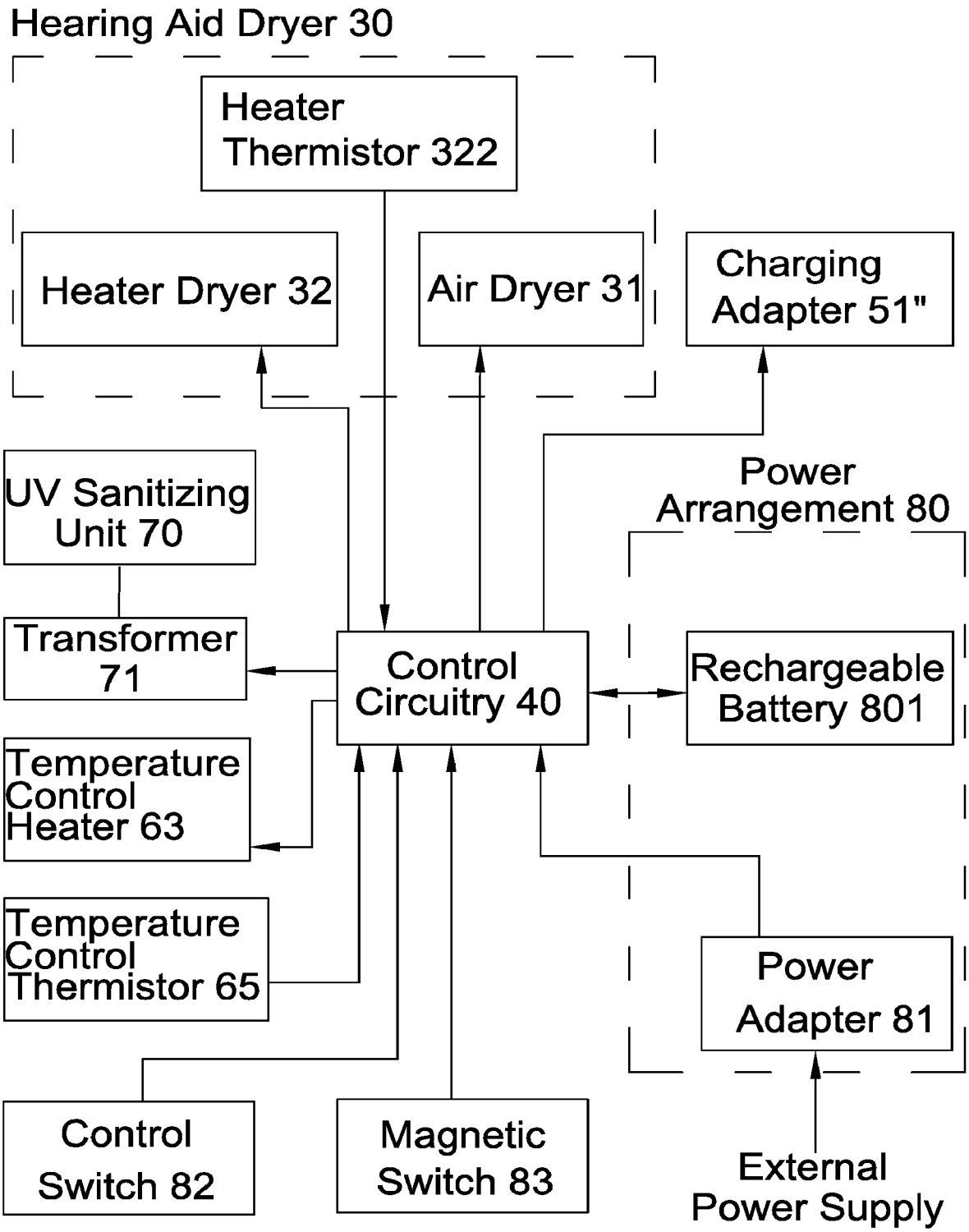
FIG. 13 is a block diagram illustrating the third alternative mode of the universal charging and drying station according to the preferred embodiment of the present invention.

Referring to FIG. 12 to FIG. 13 of the drawings, a third alternative mode of the present invention is illustrated. The third alternative mode is similar to the preferred embodiment, except the universal charging and drying station of the present invention may be configured such that the components mentioned in the preferred embodiment may be selectively provided on the main unit 100, as in the second alternative mode.

According to the third alternative mode, the universal charging and drying station may comprise a main unit 100 and a hearing aid charger 500" comprising a charging adapter 51" The main unit 100 may comprise a main casing 10, a lid 20, a hearing aid dryer 30, a control circuitry 40, and a temperature control arrangement 60.

The difference between the preferred embodiment and the third alternative mode is that the universal charging and drying station may comprise a standard hearing aid charger 500" but with the temperature control arrangement 60. The other components remain identical to that described in the preferred embodiment above. Thus, the hearing aid charger 500" may comprise a plurality of charging adapters 51" (but at least one) securely provided on the main unit 100 and electrically connected to the control circuitry 40. The charging adapter 51" may have a plurality of adapter terminals 521" for electrically connecting to the charging terminals 203 of the hearing aids 200 respectively. Each of the charging adapters 51" may have a supporting seat 511" for accommodating the hearing aid units 201 of the hearing aids 200. The charging adapters 51" may be securely provided on the main casing 10 without any interchangeable function.

However, when the lid 20 is pivotally to create the drying chamber 211 and the charging chamber 212, the temperature control arrangement 60 may operate to provide temperature gradient for the drying chamber 211 and the charger chamber 212. The mechanism is identical to the one described in the preferred embodiment above. The difference between the third alternative mode and the preferred embodiment is just the hearing aid charger 50".

Figure 14:
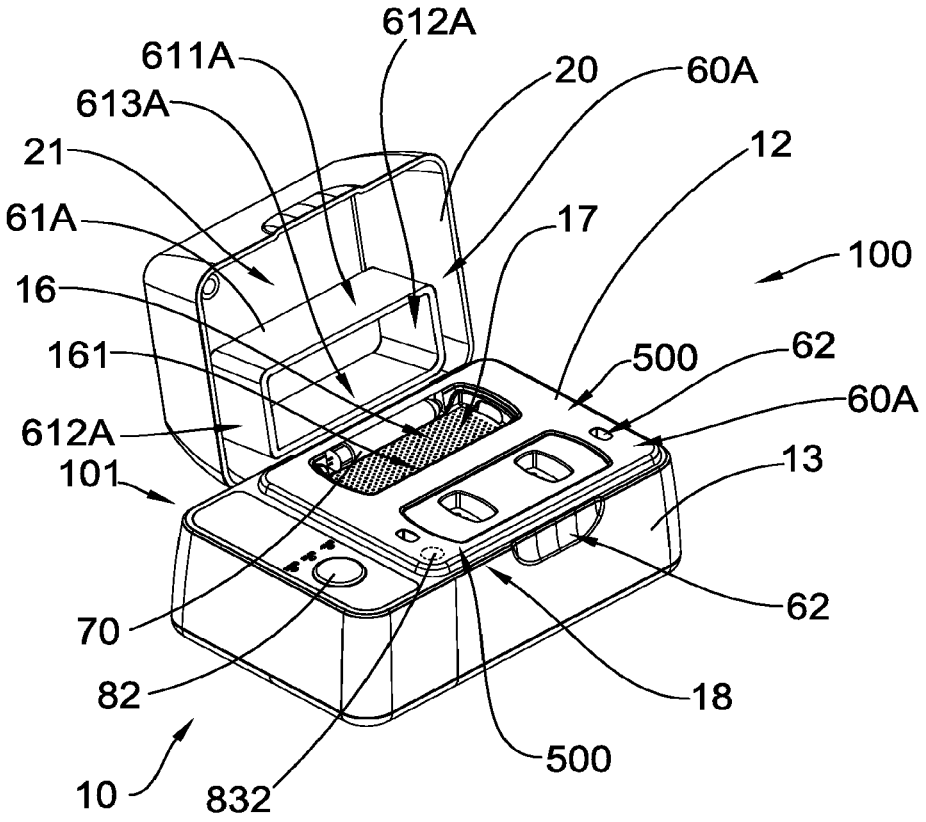
FIG. 14 is a fourth alternative mode of the universal charging and drying station according to the preferred embodiment of the present invention.

Referring to FIG. 14 of the drawings, a fourth alternative mode of the present invention is illustrated. The fourth alternative mode is similar to the preferred embodiment, except the partitioning member 61A of the temperature control arrangement 60A. According to the fourth alternative mode, the partitioning member 61A may be supported by and extend from the lid 20 instead of extending from the utility platform 12. Moreover, the partitioning member 61A may have a may have a front portion 611A, two side portions 612A rearwardly extended from two ends of the front portion 611A, and a rear portion 613A extended between the rear end of the two side portions 612A. Again, the space surrounded by the partitioning member 61A and the lid 20 in the utility compartment 21 may be defined as the drying chamber 211 for the purpose of forming a first temperature zone for the universal charging and drying station. On the other hand, the space outside the drying chamber 211 in the utility compartment 21 may be defined as the charging chamber 212 for the purpose of forming a second temperature zone for the universal charging and drying station. The front portion 611A may be positioned between a side edge 161 of the drying cavity 16 and the interchangeable adapter unit 50. Note that each of the front portion 611A, side portions 612A and the rear portion 613A may have a rectangular cross-sectional shape. Other cross-sectional shapes are also possible.

The present invention, while illustrated and described in terms of a preferred embodiment and several alternatives, is not limited to the particular description contained in this specification. Additional alternative or equivalent components could also be used to practice the present invention.

What is claimed is:

1. A universal charging and driving station for a hearing aid having a hearing aid unit and an earbud, comprising:

a main unit, which comprises:

a main casing having a driving platform for supporting said earbud;

a lid movably provided on said main casing for defining a utility compartment:

a hearing aid driver supported in said main casing for drying said hearing aid on said drying platform; and a control circuitry supported in said main casing and electrically connected to said hearing aid dryer; and a hearing aid charger, which comprises:

a receptacle connector supported by said main casing and electrically connected to said control circuitry; and at least one interchangeable adapter unit, which comprises:

a charging adapter, and a connecting module supported by said charging adapter, said connecting module having at least one adapter terminal electrically connecting to said hearing aid, and at least one connecting member electrically connected to said receptacle connector, said interchangeable adapter unit being operated between a charging mode and an interchangeable mode, wherein in said charging mode, said connecting module is electrically connected to said receptacle connector through said connecting member for charging said hearing aid, wherein in said interchangeable mode, said connecting module is electrically disconnected from said receptacle connector for interchange of said interchangeable adapter unit, wherein said control circuitry comprises a printed circuit board and a control circuit implemented on said printed circuit board, said receptacle connector comprises a plurality of connector terminals detachably connected to said charging adapter, said connector terminals being provided on said printed circuit board.

2. The universal charging and drying station, as recited in claim 1, wherein said main casing further has a through receptacle slot formed on said utility platform at a position corresponding to that of the receptacle connector, so that said receptacle connector is exposed to said utility compartment through said receptacle slot.

3. The universal charging and drying station, as recited in claim 2, further comprising a plurality of interchangeable adapter units wherein each of said interchangeable adapter units is specifically adapted for charging a predetermined hearing aid, each of said interchangeable adapter units freely attaching to or detaching from said receptacle connector.

4. The universal charging and drying station, as recited in claim 1, wherein said connecting module comprises a connecting circuit supported by said corresponding charging adapter wherein said adapter terminals are formed as electrical contacts of said connecting circuit, said connecting module further comprising a plurality of connecting members electrically and detachably connected to said connector terminals of said receptacle connector.

5. The universal charging and drying station, as recited in claim 4, further comprising a temperature control arrangement, which comprises a partitioning member provided in said utility compartment to divide said utility compartment into a drying chamber for accommodating at least one earbud of said hearing aid, and a charging chamber for accommodating at least said hearing aid unit of said hearing aid.

6. The universal charging and drying station, as recited in claim 5, wherein said main casing has a drying cavity indently formed on said main casing, wherein said drying platform is provided in said drying cavity, said main casing further having a plurality of ventilating meshes formed on at least one of a surrounding wall of said drying cavity and said drying platform, wherein said hearing aid dryer is arranged to dry primarily said earbud of said hearing aid through said ventilating meshes when said earbud is disposed in said drying cavity.

7. The universal charging and drying station, as recited in claim 6, wherein said partitioning member has a U-shaped cross section as viewed from a top side of said universal charging and drying station, and is provided in said utility compartment to surround said drying platform, said partitioning member having a front portion and two side portions rearwardly extended from two ends of said front portion, said front portion being positioned between a proximal side edge of said drying cavity and said interchangeable adapter unit, a space surrounded by said partitioning member and said lid in said utility compartment being defined as said drying chamber, a space outside said drying chamber in said utility compartment being defined as said charging chamber.

8. The universal charging and drying station, as recited in claim 7, wherein said temperature control arrangement further comprises at least one air inlet formed on said main casing for allowing air which has a lower temperature than that of said charging chamber to be drawn therein.

9. The universal charging and drying station, as recited in claim 8, wherein a height of said front portion and said side portions is identical so that each of said front portion and said side portions has a substantially rectangular cross-sectional shape, said height of said partitioning member being slightly less than that of said utility compartment to create a gap between a top edge of said partitioning member and an inner surface of said lid so as to allow said earbud of said hearing aid to pass through said gap.

10. The universal charging and drying station, as recited in claim 8, further comprising a plurality of interchangeable adapter units wherein each of said interchangeable adapter units is specifically adapted for charging a predetermined hearing aid, each of said interchangeable adapter units freely attaching to or detaching from said receptacle connector.

11. The universal charging and drying station, as recited in claim 5, wherein said hearing aid dryer comprises a heater dryer provided in said main casing and electrically connected to said control circuitry, said temperature control arrangement comprising a temperature control heater provided in said main casing and electrically connected to said control circuitry, said heater dryer and said temperature control heater being positioned in said main casing to provide heating primarily to said drying chamber and said charging chamber respectively.

12. The universal charging and drying station, as recited in claim 1, wherein said connecting module comprises a connecting circuit supported by said charging adapter, said connecting circuit comprising a plurality of wireless inductive charging coils and a plurality of connecting members electrically and detachably connected to said connector terminals of said receptacle connector.

13. The universal charging and drying station, as recited in claim 12, further comprising a plurality of interchangeable adapter units wherein each of said interchangeable adapter units is specifically adapted for charging a predetermined hearing aid, each of said interchangeable adapter units freely attaching to or detaching from said receptacle connector.

14. A universal charging and driving station for a hearing aid having a hearing aid unit and an earbud, comprising:

a main unit, which comprises:

a main casing having a driving platform for supporting said earbud;

a lid movably provided on said main casing for defining a utility compartment;

a hearing aid dryer supported in said main casing for drying said hearing aid on said drying platform; and a control circuitry supported in said main casing and electrically connected to said hearing aid dryer, and a hearing aid charger, which comprises:

a receptacle connector supported by said main casing and electrically connected to said control circuitry; and at least one interchangeable adapter unit, which comprises:

a charging adapter, a connecting module supported by said charging adapter, said connecting module having at least one adapter terminal electrically connecting to said hearing aid, and at least one connecting member electrically connected to said receptacle connector, said interchangeable adapter unit being operated between a charging mode and an interchangeable mode, wherein in said charging mode, said connecting module is electrically connected to said receptacle connector through said connecting member for charging said hearing aid, wherein in said interchangeable mode, said connecting module is electrically disconnected from said receptacle connector for interchange of said interchangeable adapter unit, and a temperature control arrangement, which comprises a partitioning member provided on said main casing to divide said utility compartment into a drying chamber for accommodating at least one earbud of said hearing aid, and a charging chamber for accommodating at least said hearing aid unit of said hearing aid.

15. The universal charging and drying station, as recited in claim 14, wherein said partitioning member has a U-shaped cross section as viewed from a top side of said universal charging and drying station, and is provided in said utility compartment to surround said drying platform, said partitioning member having a front portion and two side portions rearwardly extended from two ends of said front portion, said front portion being positioned between said drying platform and said interchangeable adapter unit, a space surrounded by said partitioning member and said lid in said utility compartment being defined as said drying chamber, a space outside said drying chamber in said utility compartment being defined as said charging chamber.

16. The universal charging and drying station, as recited in claim 15, wherein said temperature control arrangement further comprises at least one air inlet formed on said main casing for allowing air which has a lower temperature than that of said charging chamber to be drawn therein.

17. The universal charging and drying station, as recited in claim 16, wherein a height of said front portion and said side portions is identical so that each of said front portion and said side portions has a substantially rectangular cross-sectional shape, said height of said partitioning member being slightly less than that of said utility compartment to create a gap between a top edge of said partitioning member and an inner surface of said lid so as to allow said earbud of said hearing aid to pass through said gap.

18. The universal charging and drying station, as recited in claim 14, wherein said hearing aid dryer comprises a heater dryer provided in said main casing and electrically connected to said control circuitry, said temperature control arrangement comprising a temperature control heater provided in said main casing and electrically connected to said control circuitry, said heater dryer and said temperature control heater being positioned in said main casing to provide heating primarily to said drying chamber and said charging chamber respectively.

19. The universal charging and drying station for a hearing aid comprising a hearing aid unit and an earbud, said universal charging and drying station comprising:

a main casing having a drying platform for accommodating said earbud of said hearing aid;

a lid movably provided on said main casing for defining a utility compartment as a space formed between said lid and said main casing;

a hearing aid charger comprising a charging adapter having an adapter terminal provided on said main casing for electrically connecting to said hearing aid;

a hearing aid dryer supported in said main casing;

a control circuitry supported in said main casing and electrically connected to said hearing aid dryer and said charging adapter; and a temperature control arrangement, which comprises:

a partitioning member provided in said utility compartment to divide said utility compartment into a drying chamber for accommodating at least said earbud of said hearing aid, and a charging chamber for accommodating said hearing aid unit of said hearing aid; and at least one air inlet formed on said main casing for allowing air which has lower temperature than that of said charging chamber to be drawn therein for creating two different temperature zones for said drying chamber and said charging chamber respectively.

20. The universal charging and drying station, as recited in claim 19, wherein said main casing has a drying cavity indently formed on said main casing, wherein said drying platform is provided in said drying cavity, said main casing further having a plurality of ventilating meshes formed on at least one of a surrounding wall of said drying cavity and said drying platform, wherein said hearing aid dryer is arranged to dry primarily said earbud of said hearing aid through said ventilating meshes when said earbud is disposed in said drying cavity.

21. The universal charging and drying station, as recited in claim 20, wherein said partitioning member has a U-shaped cross section as viewed from a top side of said universal charging and drying station, and is provided in said utility compartment to surround said drying cavity, said partitioning member having at least a front portion and two side portions rearwardly extended from two ends of said front portion, a space surrounded by said partitioning member and said lid in said utility compartment being defined as said drying chamber, a space outside said drying chamber in said utility compartment being defined as said charging chamber.

22. The universal charging and drying station, as recited in claim 21, wherein a height of said front portion and said side portions is identical so that each of said front portion and said side portions has a substantially rectangular cross-sectional shape, said height of said partitioning member being slightly less than that of said utility compartment to create a gap between a top edge of said partitioning member and an inner surface of said lid so as to allow said earbud of said hearing aid to pass through said gap.

23. The universal charging and drying station, as recited in claim 19, wherein said partitioning member has a U-shaped cross section as viewed from a top side of said universal charging and drying station, and is provided in said utility compartment to surround said drying platform, said partitioning member having at least a front portion and two side portions rearwardly extended from two ends of said front portion, a space surrounded by said partitioning member and said lid in said utility compartment being defined as said drying chamber, a space outside said drying chamber in said utility compartment being defined as said charging chamber.

* * * * *